US005469147A

United States Patent [19]

Trey et al.

[11] Patent Number: 5,469,147

[45] Date of Patent: Nov. 21, 1995

[54] SMOKE DETECTOR DEVICE, ESPECIALLY FOR A SPACE IN AN AIRCRAFT

[75] Inventors: Heiko Trey, Ganderkesse; Thomas Grabow, Weyhe-Leeste; Eckhard Steinbrink, Stuhr, all of Germany

[73] Assignee: Deutsche Aerospace Airbus GmbH, Hamburg, Germany

[21] Appl. No.: 28,982

[22] Filed: Mar. 10, 1993

[30] Foreign Application Priority Data

Mar. 12, 1992 [DE] Germany ..... 42 07 807.5

[51] Int. Cl.[6] ..... G08B 17/10

[52] U.S. Cl. ..... 340/628; 340/693

[58] Field of Search ..... 340/628, 693, 340/629, 630; 250/574, 381, 382, 384

[56] References Cited

U.S. PATENT DOCUMENTS

| | | | |
|---|---|---|---|
| 4,121,110 | 10/1978 | Solomon | 340/630 |
| 4,630,037 | 12/1986 | Escamilla, Jr. | 340/628 |
| 4,812,827 | 3/1989 | Scripps | 340/628 |
| 4,937,562 | 6/1990 | Kaminaka et al. | 340/628 |
| 5,339,072 | 8/1994 | Agata | 340/628 |

*Primary Examiner*—Edward L. Coles, Sr.
*Assistant Examiner*—Thomas L. Stoll
*Attorney, Agent, or Firm*—W. G. Fasse; W. F. Fasse

[57] ABSTRACT

A smoke detector device for signalling a smoke detection in a space in an aircraft such as a cabin, a toilet, or a cargo hold of an aircraft, is mounted in a recessed position in a hole in a wall or ceiling of the aircraft. The device has at least one smoke detector enclosed in a housing (3) that also holds a smoke guide ring forming a funnel collar (7) for guiding smoke from a smoke collecting entrance (9) into a detector inlet opening (11) facing toward the space. The funnel collar (7) has a bottom (10) extending essentially on one level with the smoke inlet opening (11) of the smoke detector. The funnel collar tapers from the smoke collecting entrance (9) of the smoke guide rim to the smoke detector inlet opening (11) to form a smoke trap wherein a smoke stream toward the smoke detector is guided and accelerated. The smoke guide rim itself may function as a mounting for one or more smoke detectors, whereby a separate housing is obviated.

14 Claims, 2 Drawing Sheets

FIG. 1
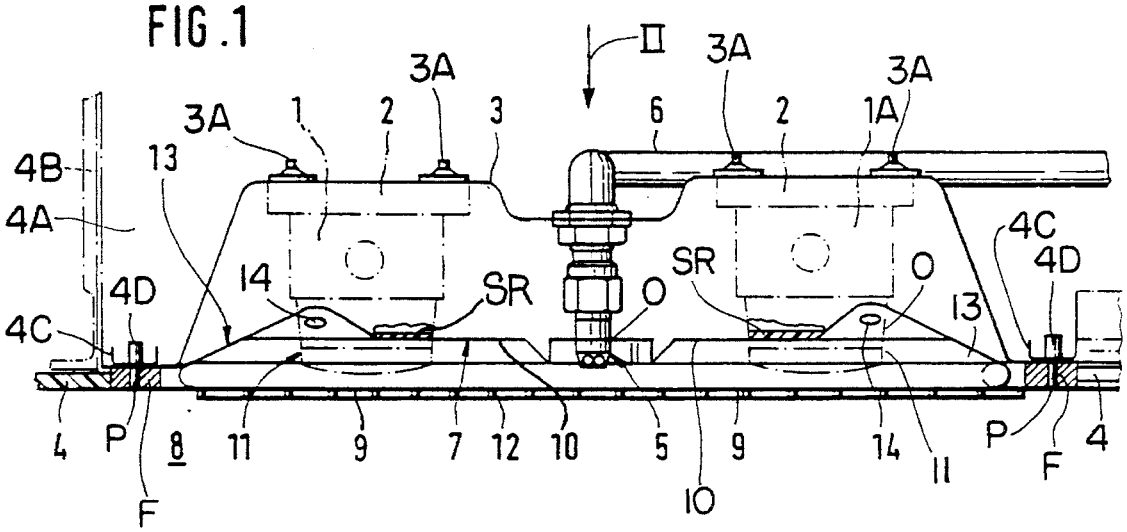
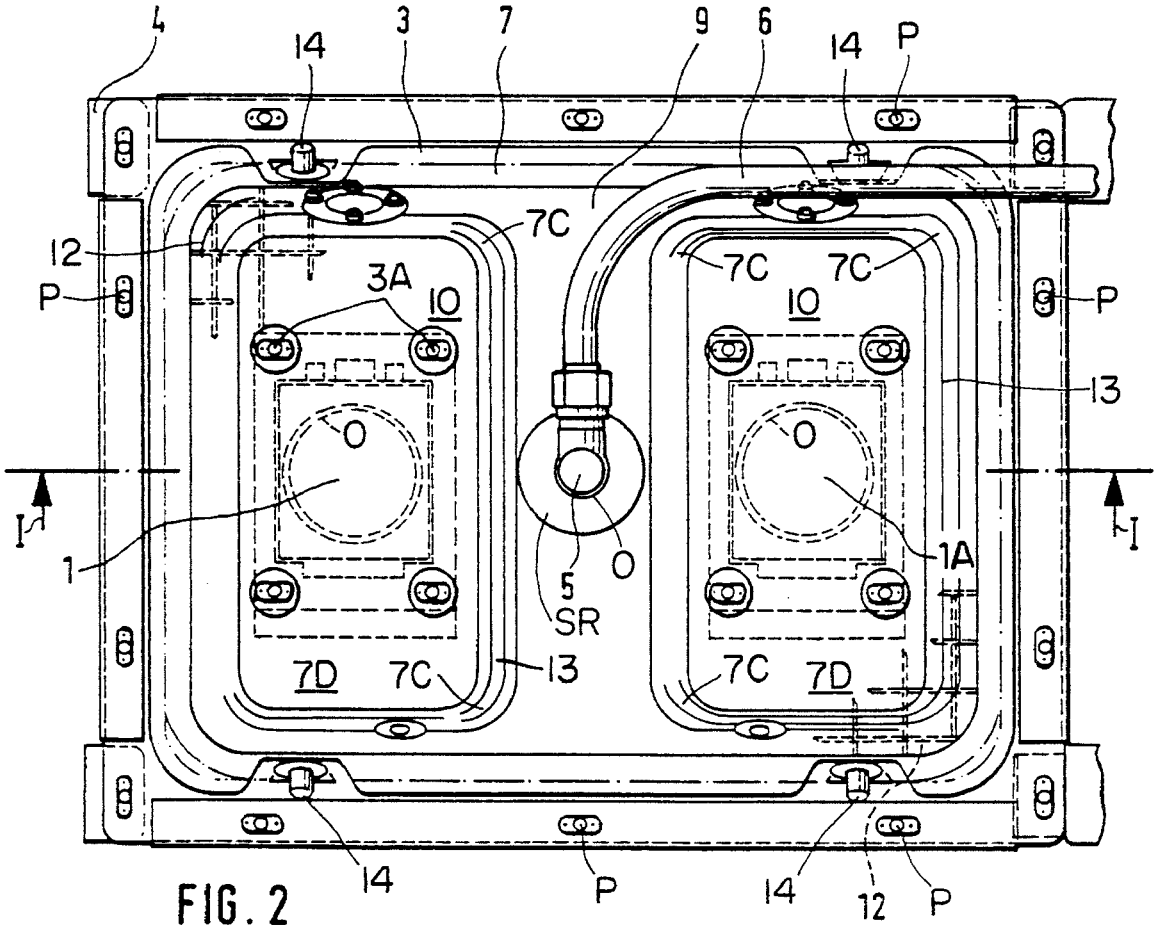
FIG. 2

FIG. 3
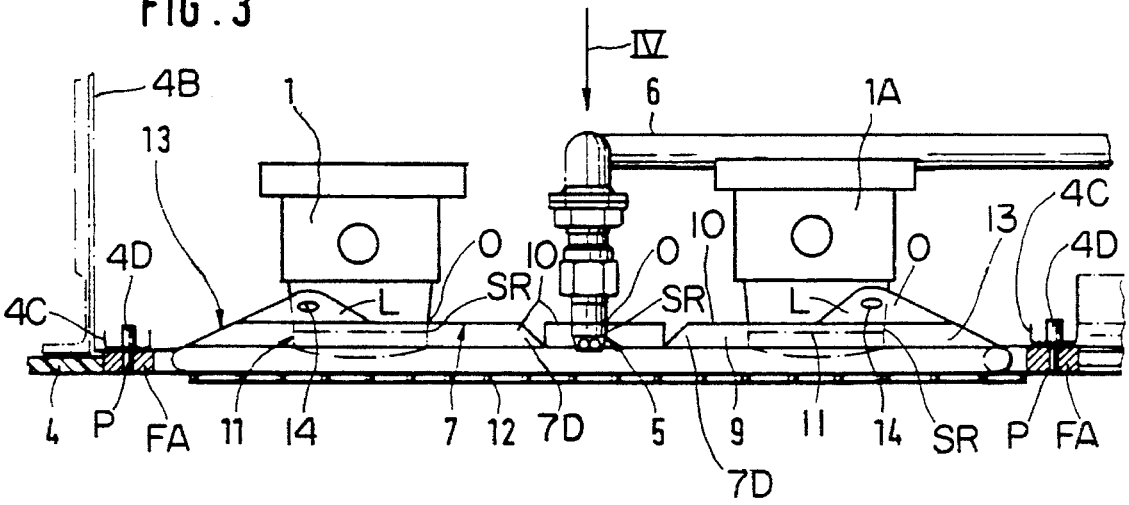
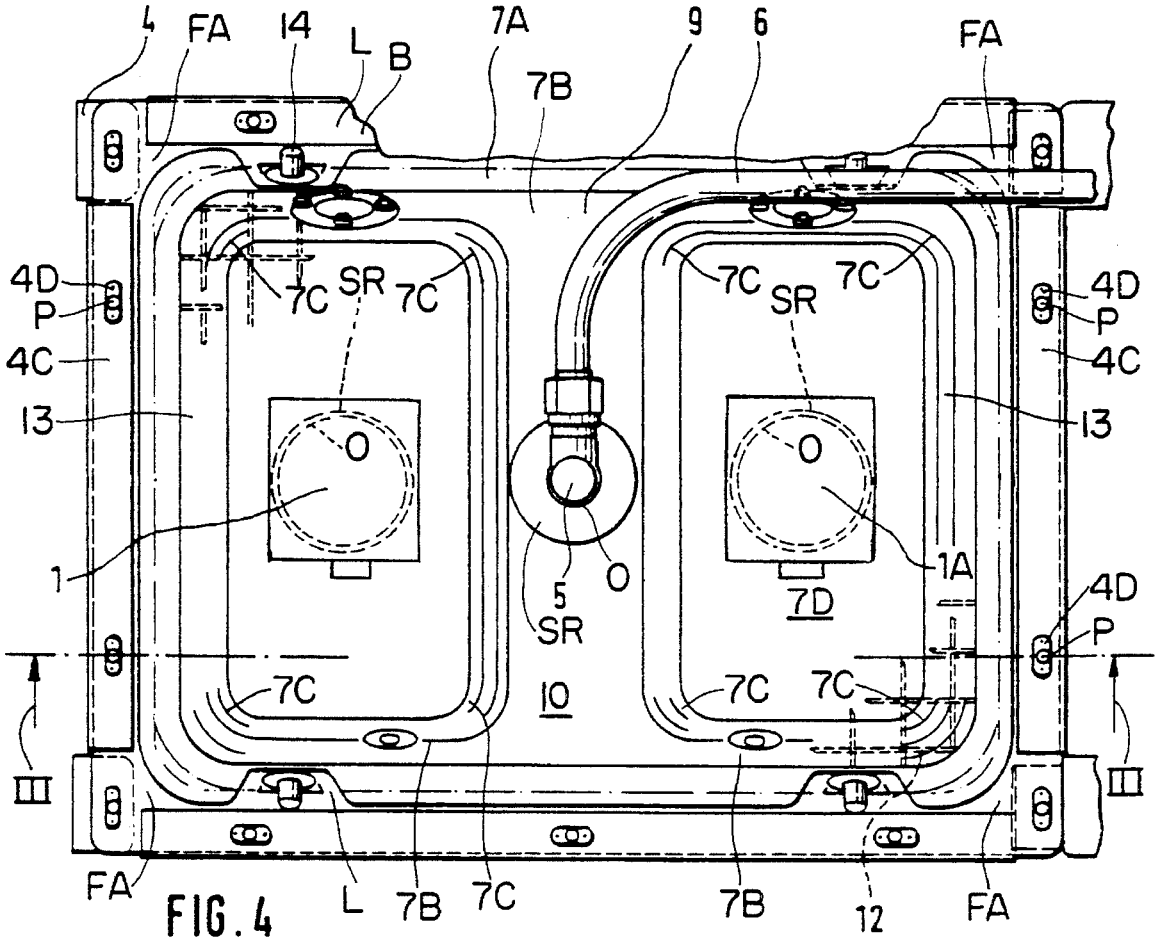
FIG. 4

SMOKE DETECTOR DEVICE, ESPECIALLY FOR A SPACE IN AN AIRCRAFT

FIELD OF THE INVENTION

The invention relates to an apparatus for detecting smoke in a confined space such as a cabin in an aircraft. Such smoke detectors or sensors are attached to a wall or ceiling in a recess so that a smoke entrance is positioned substantially flush with the surface area of the wall or ceiling. At least a portion of the sensor is mounted in a housing that is received in the recess.

BACKGROUND INFORMATION

Such smoke detectors can be used e.g. in the passenger or baggage compartments of an aircraft, in order to detect a fire promptly by the smoke that develops. After a fire has been detected, suitable fire extinguishing efforts can be introduced. With regard to a baggage compartment or cargo hold, for example, it is possible to first flood the entire compartment or hold with a high dose of a gaseous extinguishing medium, in order to extinguish the fire, and subsequently, until the end of the flight, to maintain a minimum concentration of extinguishing medium in the contained atmosphere.

In order to avoid damage of the smoke detectors, as well as to avoid hindrances by the detectors, they are preferably mounted in a recessed manner in a ceiling, as mentioned. Enclosure shells or mounting housings are used for this purpose and the smoke detectors are secured by screws in the housing or shell, to encapsulate the detectors in the ceiling structure, except for the smoke entrance that remains open so that developing smoke can stream into the enclosure shell to reach the detector. Due to the flow dynamic conditions to which the smoke stream is exposed as it travels through the smoke entrance and due to the volume of the enclosure shell a certain length of time passes, before the smoke concentration within the enclosure shell is sufficient to produce a signal by triggering the detector. Due to the resulting delay it is not always ensured under all circumstances, that the prescribed short response times are met.

OBJECTS OF THE INVENTION

In view of the foregoing it is the aim of the invention to achieve the following objects singly or in combination:

to improve a smoke detector apparatus so that the response time between the beginning of a smoke and the generation of a warning signal is shortened;

to improve the smoke collection and guidance of smoke into the smoke inlet of the detector; and to construct a smoke guide rim, so that it may be used even in existing smoke detectors to improve their ability to collect smoke more efficiently, and to use the rim as a mounting.

SUMMARY OF THE INVENTION

These objects are achieved, according to the invention, in that an inner bottom of a smoke guide rim insertable into a mounting recess in a wall or ceiling, is positioned essentially on the same level on which a smoke inlet or opening of the smoke detector is arranged, and in that the smoke guide rim has a funnel collar tapering from a smoke collecting entrance of the rim toward the detector smoke inlet or opening in order to produce and accelerate a stream of smoke, whereby the smoke guide rim with its bottom and its funnel collar form a smoke trap that funnels the smoke directly into the detector smoke inlet opening. The smoke guide rim either forms directly a mounting for one or more smoke detectors, or the rim and the smoke detectors are together mounted in a housing that in turn is mounted in the recess in a wall or ceiling.

The above arrangement of the smoke guide rim has a small smoke guide volume, which quickly takes in the smoke prevailing concentration. The tapering of the funnel collar of the smoke guide rim in the direction toward the inlet opening of the smoke detector greatly facilitates the production of an accelerated smoke stream that flows quickly to the detector smoke inlet. These structural features in combination achieve a response lag that is less than 60 seconds.

The entrance of smoke to the smoke detector inlet or opening is facilitated in that the smoke inlet opening essentially faces in the direction of the smoke collecting entrance of the guide rim. However, it is also possible to position the detector smoke inlet or opening to face laterally, whereby advantage is taken of the fact, that smoke tends to stream and spread out in parallel to a surface whereby the present rim bottom feeds the smoke directly into the lateral detector opening.

An improved operating safety is achieved by a redundant arrangement of two smoke detectors in a common guide rim and an extinguishing nozzle arranged between the two detectors.

In order to facilitate a simple operation and a compact structure, the smoke guide rim is constructed as an insert that has recesses or holes for the smoke detector and the extinguishing nozzle, through which these components extend into the inner portion of the funnel collar portion of the smoke guide rim.

A simple adaptation of conventional smoke detector devices of this type is achieved by outfitting these conventional devices with a smoke guide rim of the invention formed as a supplementary component preferably with a safety screen that can be attached to the housing at its smoke collecting entrance.

In order to minimize the component weight, the mounting housing can be omitted and the detector is directly mounted to a smoke guide rim constructed as a carrying element for the smoke detector.

An aimed smoke stream guidance into lateral smoke inlet openings of the detector is achieved in that the smoke guide rim has an essentially flat bottom, preferably located at a level approximately corresponding to a plane in which the lateral smoke inlet openings are located.

In order to take advantage of the thermodynamic flow conditions arising from the formation of smoke streams, a modified embodiment of the invention includes a component group of at least one smoke detector and said smoke guide rim and the group is attached in the region of a ceiling in an aircraft. Depending on the structural condition of the aircraft, it is however, also possible that the component group of the smoke detector and the smoke guide rim are attached to or in a recess of a vertical wall in the aircraft.

To avoid the dilution of the smoke within the volume of the inner portion of the smoke guide rim, it is suggested that a sealing ring or caulking is provided around an opening into which the smoke detector extends in the bottom of the smoke guide rim.

BRIEF DESCRIPTION OF THE DRAWINGS

In order that the invention may be clearly understood, it will now be described, by way of example, with reference to the accompanying drawings, wherein:

FIG. 1 is a side view of the present smoke detector in its housing shown partly in section line I—I of FIG. 2;

FIG. 2 is a plan view onto the smoke detector as viewed in the direction of the arrow II in FIG. 1 illustrating the back side of the detector housing;

FIG. 3 is a side view of a second embodiment of the present smoke detector with a flat housing shown partly in section line III—III of FIG. 4; and FIG. 4 is a plan view onto the back side of the smoke detector as viewed in the direction of the arrow IV in FIG. 3.

DETAILED DESCRIPTION OF PREFERRED EXAMPLE EMBODIMENTS AND OF THE BEST MODE OF THE INVENTION

FIGS. 1 and 2 show one embodiment of the present apparatus for signalling the presence of smoke. The device comprises two smoke detectors 1 and 1A, which are screwed to a mounting housing 3 in the region of a detector base 2 by screws 3A. The mounting housing 3 is connected to a wall or ceiling 4 in which a recess 4A is formed in a frame member 4B. A fire extinguishing nozzle 5 attached to a pipe 6 for an extinguishing medium,is arranged between the two smoke detectors 1 and 1A to form a group of elements as a structural unit. The housing 3 has a flange F for securing the housing 3 to a frame bracket 4C carrying a snap fastener 4D in which a fastening pin P or the like is received to secure the flange F and thus the housing 3 to the frame 4B.

According to one embodiment of the invention a smoke guide rim includes a funnel collar 7 and an outer edge forming a smoke collecting entrance 9 facing toward the inner space or cabin 8 of an aircraft. The rim further includes a bottom 10 with holes 0 in the bottom 10. The rim forms a mounting bracket that is inserted into the mounting housing 3 and held therein, e.g. by snap fasteners 14 for mounting the smoke detectors 1, 1A. The rim slopes with its funnel collar 7 from the smoke collecting entrance 9 toward a smoke inlet or opening 11 of the respective detector 1, 1A to form a funnel for collecting and accelerating smoke toward and into the opening 11 forming a smoke inlet to the detector. A base or bottom of the rim extends approximately or substantially at a level, at which the smoke inlet opening 11 of the smoke detector 1 is arranged. To prevent damage to the smoke detector 1, a safety screen 12 that is secured to the mounting housing 3,covers the smoke collecting entrance 9. The mounting of the rim to the housing 3 and of the screen 12 to the rim or to the housing is achieved, for example, with screws or with snap fasteners 14 mentioned above.

In order to improve the guidance of a smoke stream within the enclosing rim with its funnel collar 7, the collar 7 tapers from the smoke collecting entrance 9 toward the smoke inlet opening 11 of the detector 1, 1A to form a funnel for guiding smoke from the smoke collecting entrance 9 along slanted side walls 13 of the collar 7 toward the opening 11 of the detector 1, 1A surrounded by the base or bottom 10 provided with the holes O for this purpose. The extinguishing nozzle 5 extends partly through a respective hole O from a back region into the enclosing funnel collar 7. The rim with its funnel collar 7 may also be mounted to the safety screen 12 by welding or by other suitable means. A sealing ring SR or caulking seals the holes O to prevent smoke from entering into the space behind the bottom 10 of the rim.

In the example embodiment according to FIGS. 1 and 2, the enclosing rim with its funnel collar 7 is constructed as a supplementary element, which can be built into already existing mounting housings 3 for an improved smoke guiding. In order to facilitate a simple installation into existing units, the enclosing rim with its funnel collar 7 is connected to a safety screen so that the safety screen 12 and the rim with its funnel collar 7 can be mounted as a unit, whereby the smoke detectors land the extinguishing nozzle 5 extend into the inner portion of the funnel collar through the holes O.

Again snap fasteners 14 are preferred for securing the unit of the safety screen 12 and the rim 7 in place.

In the example embodiment of FIGS. 3 and 4, the enclosing smoke guide rim 7A is constructed as a carrying component that holds the smoke detectors 1 and 1A and the extinguishing nozzle 5 mounted to the bottom 10 which forms a mounting platform for the detectors. The smoke guide rim 7A with its funnel collars 7B is provided with a flange FA that is held by pin fasteners P to the wall or ceiling. More specifically, in this embodiment, the flange FA is secured to the smoke guide rim 7A by lobes L and snap fasteners 14. The flange FA in turn is secured to brackets 4C of the wall or ceiling member 4B by the fasteners 4D in which the pins P are received. In order to facilitate mounting of the safety screen 12, the funnel collars 7B of the smoke guide rim 7A have suitable arches 7C that form two troughs 7D to assure accessibility for the snap fasteners 14. Troughs 7D form a funnel for each detector for guiding smoke into the respective detector inlet.

To prevent smoke from escaping out of the inner portion of the enclosing rim 7 or 7A, which would cause a lowering of the smoke concentration, the smoke detectors 1, 1A and the extinguishing nozzle 5 are preferably sealed off relative to the enclosing rim 7, 7A by a sealing element SR formed, for example, as a prefinished sealing ring or gasket inserted into the respective holes O. However, it is also possible to provide a subsequent seal with the aid of a plyable sealing material such as caulking.

Although the invention has been described with reference to specific example embodiments, it will be appreciated that it is intended to cover all modifications and equivalents within the scope of the appended claims.

What we claim is:

1. An apparatus for signalling a smoke detection in an enclosed space comprising a mounting for attaching said apparatus in a recess of a wall or ceiling enclosing said enclosed space (8), at least a first smoke detector (1) secured to said mounting, said first smoke detector (1) having a smoke detector inlet (11) facing toward said enclosed space (8) and defining a smoke detector inlet plane, a smoke guide rim comprising an outer edge forming an entrance (9) for collecting smoke to be detected, a guide rim bottom (10) having an opening (O) surrounding said smoke detector inlet (11) approximately in said smoke detector inlet plane, and a funnel collar (7) having slanted walls tapering from said smoke collecting entrance (9) to said bottom (10) for guiding smoke from said smoke collecting entrance (9) to said smoke detector inlet (11), said funnel collar (7) narrowing from said outer edge toward said bottom (10) for directing a smoke stream toward said smoke detector inlet (11) surrounded by said bottom opening (O) in said guide rim bottom (10).

2. The apparatus of claim 1, wherein said smoke detector inlet (11) of said first smoke detector (1) essentially faces in the direction of said smoke collecting entrance (9) of said smoke guide rim facing said enclosed space.

3. The apparatus of claim 1, further comprising a second smoke detector (1A) also secured to said mounting, and a fire extinguishing nozzle (5) arranged between said first and second smoke detectors (1, 1A).

4. The apparatus of claim 3, wherein said smoke guide rim with said funnel collar (7) is formed as an insert fitting into said mounting, said insert having three openings (O) in said bottom (10) for said first and second smoke detectors (1, 1A) and for said fire extinguishing nozzle (5), said first and second smoke detectors (1, 1A) and said nozzle (5) extending through said openings (O) into an inner region surrounded by said slanted walls of said funnel collar (7).

5. The apparatus of claim 1, further comprising a protective grill or screen (12) secured to said outer edge of said smoke guide rim.

6. The apparatus of claim 1, wherein said bottom (10) of said smoke guide rim with its funnel collar (7) forms a mounting platform for mounting said first smoke detector (1).

7. The apparatus of claim 1, wherein said bottom (10) of said smoke guide rim is flat.

8. The apparatus of claim 1, wherein said mounting, said smoke detector (1), and said smoke guide rim with its funnel collar (7) form a component group comprising a flange (F) for mounting said component group.

9. The apparatus of claim 4, further comprising a sealing ring (SR) interposed between said bottom (10) and said first and second smoke detectors (1, 1A).

10. The apparatus of claim 1, further comprising snap-in connectors (14) for securing said smoke guide rim to said mounting.

11. The apparatus of claim 1, wherein said mounting comprises a flange (F, FA) for securing said mounting in a recess.

12. An apparatus for signalling a smoke detection in an enclosed space comprising at least a first smoke detector (1) having a smoke detector inlet (11) and a smoke guide rim (7A) having an outer edge forming an entrance (9) for collecting smoke to be detected, a bottom (10) to which said smoke detector (1) is mounted, said bottom (10) having a hole (0) surrounding said smoke detector inlet (11), and a funnel collar (7B) interconnecting said outer edge with said bottom (10), said funnel collar (7B) having slanted walls tapering from said smoke collecting entrance (9) to said smoke detector inlet (11), whereby said funnel collar (7B) is narrowing from said outer edge toward said bottom (10) for directing a smoke stream toward said smoke detector inlet (11).

13. The apparatus of claim 12, further comprising a second smoke detector (1A) also mounted to said bottom (10) of said smoke guide rim (7A), and a fire extinguishing nozzle (5) mounted to said bottom (10) between said first and second smoke detectors (1, 1A).

14. The apparatus of claim 13, wherein said bottom forms a trough (7D) for each of said smoke detectors (1, 1A), each trough (7D) guiding smoke to said smoke detector inlet (11) of its respective smoke detector (1, 1A) from said smoke collecting entrance (9).

* * * * *